US010176712B1

(12) United States Patent
Martins

(10) Patent No.: US 10,176,712 B1
(45) Date of Patent: Jan. 8, 2019

(54) INTERSECTION CONTROL SYSTEM

(71) Applicant: Rita Martins, N. Natick, MA (US)

(72) Inventor: Rita Martins, N. Natick, MA (US)

( * ) Notice: Subject to any disclaimer, the term of this patent is extended or adjusted under 35 U.S.C. 154(b) by 0 days.

(21) Appl. No.: 15/725,010

(22) Filed: Oct. 4, 2017

(51) Int. Cl.
*G08G 1/09* (2006.01)
*G08G 1/07* (2006.01)

(52) U.S. Cl.
CPC ..... *G08G 1/09* (2013.01); *G08G 1/07* (2013.01)

(58) Field of Classification Search
CPC ..... G08G 1/09; G08G 1/07
See application file for complete search history.

(56) References Cited

U.S. PATENT DOCUMENTS

| | | | | |
|---|---|---|---|---|
| 6,243,644 | B1 | 6/2001 | Dengler | |
| 6,519,884 | B1 | 2/2003 | Duhamel | |
| 6,624,782 | B2 | 9/2003 | Jocoy et al. | |
| 7,375,650 | B2 | 5/2008 | Lo | |
| 7,689,347 | B2 | 3/2010 | Wall, III | |
| 7,856,747 | B2 | 12/2010 | Haubrich | |
| 7,898,432 | B2 | 3/2011 | McNew et al. | |
| 8,676,500 | B1 | 3/2014 | Walsh | |
| 9,218,739 | B2 | 12/2015 | Trombley et al. | |
| 9,459,623 | B1 | 10/2016 | Raghu | |
| 9,558,659 | B1 | 1/2017 | Silver et al. | |
| 9,576,485 | B2 | 2/2017 | Gao | |
| 2007/0115139 | A1* | 5/2007 | Witte | G08G 1/07 340/909 |
| 2010/0283631 | A1 | 11/2010 | Bryant | |
| 2014/0267734 | A1* | 9/2014 | Hart, Jr. | G08G 1/07 348/149 |
| 2016/0005311 | A1 | 1/2016 | Holzwanger et al. | |
| 2016/0005313 | A1 | 1/2016 | Cholayil | |
| 2017/0025005 | A1* | 1/2017 | Barth | G08G 1/166 |
| 2017/0103650 | A1 | 4/2017 | Amadon | |

FOREIGN PATENT DOCUMENTS

| | | | |
|---|---|---|---|
| GB | 2 405 279 | A | 2/2005 |
| WO | 2016080939 | A1 | 5/2016 |

* cited by examiner

*Primary Examiner* — Leon Flores
(74) *Attorney, Agent, or Firm* — Lambert Shortell & Connaughton; Gary E. Lambert; David J. Connaughton, Jr.

(57) ABSTRACT

An intersection control system is provided. The system utilizes a computerized controller to dynamically display to intersection drivers whose turn it is to enter the intersection. Sensors at the intersection can determine what cars are at the intersection and when, allowing the computerized controller to automatically determine the correct order to control the intersection. In some embodiments, the computerized controller may make special accommodation to allow additional cars to enter the intersection instead of one at a time in a particular order to ease traffic.

20 Claims, 2 Drawing Sheets

INTERSECTION CONTROL SYSTEM

BACKGROUND OF THE INVENTION

Field of the Invention

The present invention relates generally to intersection control systems. More particularly the present invention relates to a system which informs vehicles when it is their turn to enter the intersection.

Description of Related Art

Vehicle intersections are a primary cause of traffic as well as traffic accidents. Primary types of intersection control systems include traffic lights, which provide visual indications of stop and go instructions, as well as four way stops, which require drivers to stop, wait their turn, and then go. While these systems have worked for decades, they still cause large traffic backups. Further, intersections are generally the most dangerous areas for drivers despite the existing intersection control solutions. Advancements in technology should make superior solutions possible to more effectively control movement of vehicles through intersections.

Therefore, what is needed is an intersection control system that may use computerized technology and/or display technology to increase intersection control efficiency.

SUMMARY OF THE INVENTION

The subject matter of this application may involve, in some cases, interrelated products, alternative solutions to a particular problem, and/or a plurality of different uses of a single system or article.

In one aspect, an intersection control system is provided. The system comprises a plurality of sensors, at least one of which is positioned at each of a plurality of sides of a road intersection. A display is positioned at one of the plurality of sides of the road intersection, and typically all sides of the intersection. This display is viewable from a vehicle on the particular intersection side that it is positioned. A computerized controller is in communication with the plurality of sensors and the display. This controller is configured to display an order (position in line) that a vehicle is in to enter the road intersection. The computerized controller is further configured to count down (for example, numerically, alphabetically, etc.) the order as the vehicle's turn approaches on the display, and configured to provide an indication on the display when it is the vehicle's turn to enter the intersection (such as "1", "A", "Go" etc.). The vehicle may then enter the intersection, which can be detected by one of the plurality of sensors, recorded by the computerized controller, which can then instruct the next vehicle in order to enter the intersection.

In another aspect, an intersection control system is provided. The system comprises a plurality of sensors, at least one of which is positioned at each of a plurality of sides of a road intersection. A display is positioned adjacent to the intersection, and may be viewable from all sides of the intersection. A computerized controller is in communication with the plurality of sensors and the display. The computerized controller is further configured to assign an indicator to each of a plurality of sides of an intersection, and based on these assigned indicators, present one of the indicators assigned to the plurality of sides of the intersection on the display. The displayed indicator corresponds to a vehicle stopped at one of the plurality of sides of the intersection whose turn it is to enter the road intersection. The vehicle may then enter the intersection, which can be detected by one of the plurality of sensors and be recorded by the computerized controller, which can then instruct the next vehicle in order to enter the intersection.

DETAILED DESCRIPTION

Figure 1:
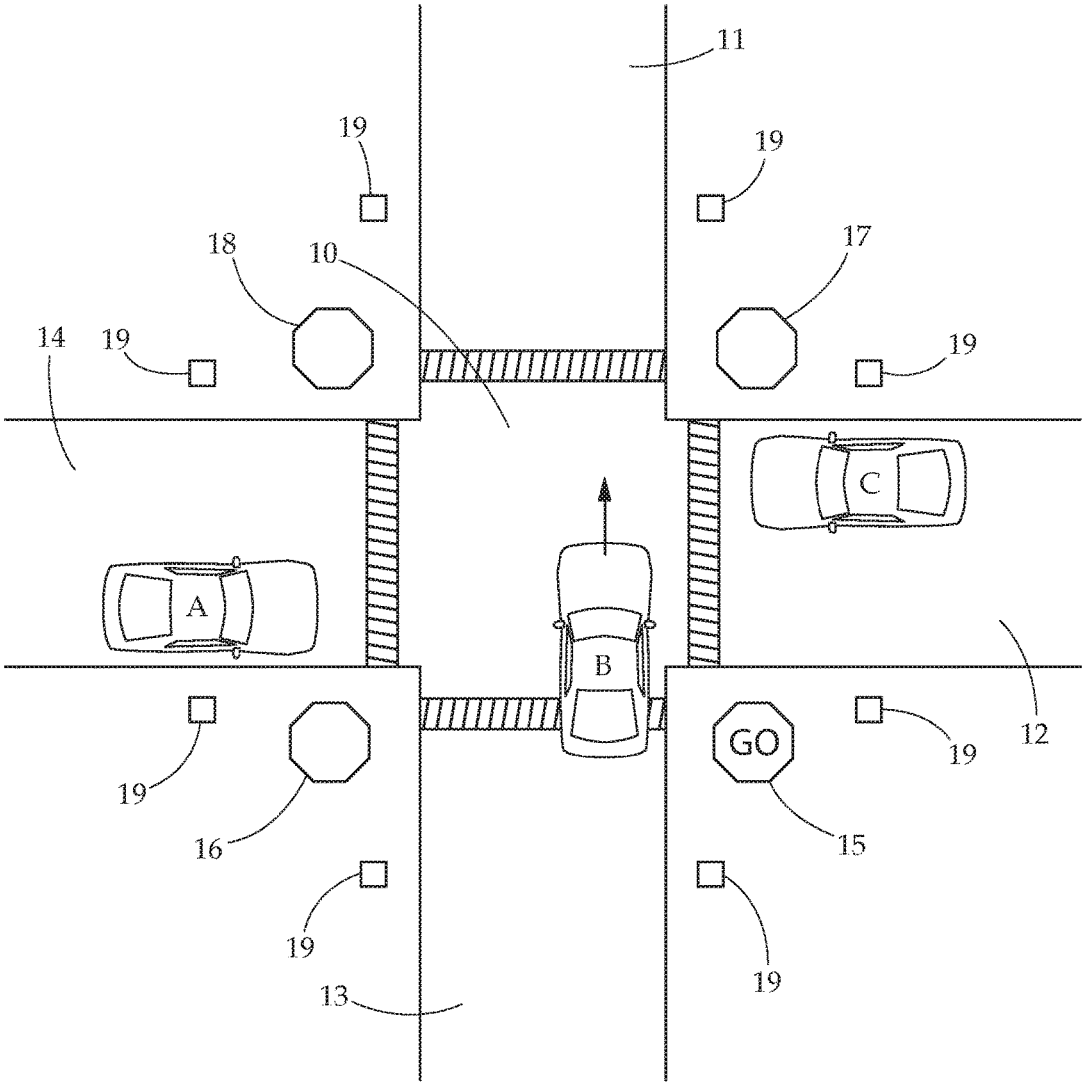
FIG. 1 provides an elevation view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns an intersection control system. The system includes one or a plurality of computer-connected visual displays which are configured to identify which side or sides of the intersection that can proceed. A plurality of sensors are configured to track when a vehicle is at a particular side of an intersection, and/or when a vehicle passes through an intersection. A computerized controller is in electronic communication with the plurality of sensors and the display or displays. In one aspect, a single display viewable from all parts of the intersection is configured to be controlled by the computerized controller to present an indicator of what side of the intersection is allowed to proceed. This may be numerical, or any other display indicator. In another aspect, one display may be positioned at each side of the intersection. In this aspect, each display may present different indicators corresponding to the order in a queue which a vehicle at the intersection is in regarding the turn to enter the intersection. For example at a four way stop, three of the four displays may indicate that it is not the vehicle's turn to proceed, while the fourth may provide an indicator to enter the intersection. As such, the present intersection control system is able to efficiently and intelligently control the intersection, reducing traffic and the danger of accidents.

The computerized controller of the present invention may be any computerized system. For example, the controller may have a processor (which may be a microprocessor, or the like), and a memory that is programmable and/or reprogrammable to operate the processor and in turn, the system. The computerized controller is configured to receive inputs from the plurality of sensors, and configured to provide an output to the display or displays.

The sensors of the present invention may be any sensor capable of determining if a vehicle is stopped at an intersection and/or if a vehicle is passing through the intersection, and/or if a vehicle is approaching the intersection. Such sensors may include, but are not limited to, pressure/weight sensors, motion sensors, optical sensors, infrared sensors, and the like. The system may further utilize cameras, which may be used as sensors or for other recording or input purposes.

The display of the present invention may be any electronically controlled or controllable display that can display a plurality of different views. A display screen such as a television-sized LCD, plasma screen, projection, and the like type display may typically be used. However, it should be understood that any display may be used without straying from the scope of this invention.

Turning now to FIG. 1, a view of an embodiment of the present invention having a display at each side of the intersection is shown. In this view, the intersection is a four way stop type intersection having two roads intersecting each other forming four approaching sides 11, 12, 13, and 14. Although of course the present invention may be used on any number of different types of intersections. The intersection 10 is controlled by displays 15, 16, 17, 18. Three of these displays 16, 17, 18, in the condition shown, are indicating for the vehicles to stop, except for display 15 which is indicating vehicle B to enter the intersection. These displays are controlled, as noted above, by output from a computerized controller (not shown). In a particular embodiment, each display 15, 16, 17, 18 may display a different indicator corresponding to a position in line of a vehicle adjacent to the display. For example, if a vehicle at display 16 is next in line, a 1, A, "Next" or other indicator may be presented on display 16. Similarly, if a vehicle at display 17 is second in line, a 2, B, or other indicator may be presented don the display. This display control, as noted, is caused by the computerized controller.

A plurality of sensors 19 are configured to detect when a vehicle is at and/or near the intersection and provide inputs to the computerized controller. These sensors 19 are shown in this embodiment as optical sensors to identify when the vehicle has crossed a line near the intersection. However, various different types of sensors may be used, on their own or in combination, without straying from the scope of this invention.

Figure 2:
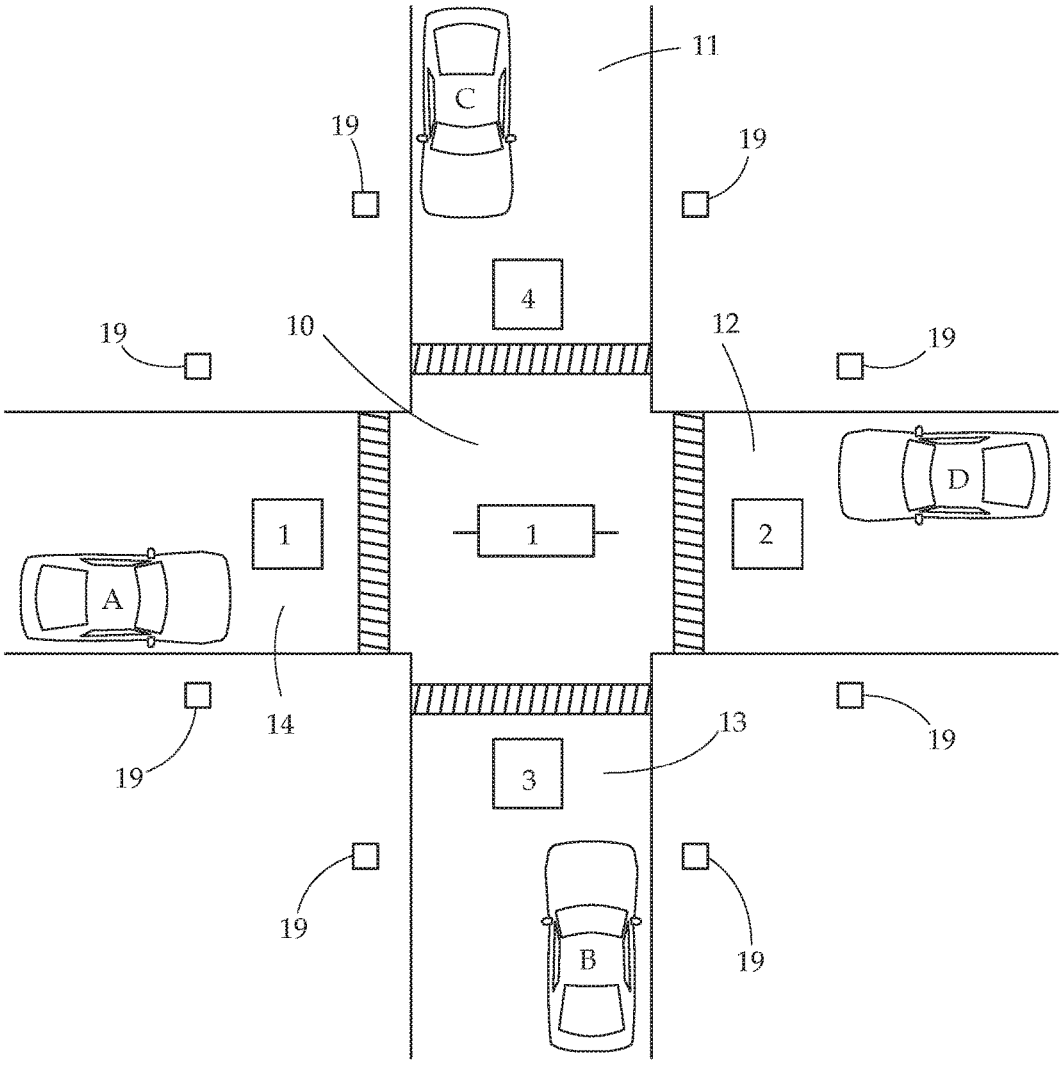
FIG. 2 provides an elevation view of another embodiment of the present invention.

FIG. 2 shows another embodiment of the present invention which utilizes a central display 1 which is visible to all of the vehicles A, B, C, D, at the four sides of the intersection 11, 12, 13, 14. The intersection 10 shown is a four way intersection, as in FIG. 1, although it should be understood that the intersection type may vary without straying from the scope of the invention. In this particular embodiment, each intersection side 11, 12, 13, 14 is assigned a number 1, 2, 3, or 4. The intersection side is then used to indicate which vehicle's turn it is to enter as displayed on the display. For example, as shown, vehicle A is on side 1. The display is showing number 1, and therefore it is vehicle A's time to enter the intersection. If the display shows 2, it is vehicle B's turn. Other indicators of intersection side and/or vehicle's turn may be used without straying from the scope of the invention and provide inputs to the computerized controller. These displays are controlled, as noted above, by output from a computerized controller (not shown). A plurality of sensors 19 are configured to detect when a vehicle is at and/or near the intersection. These sensors 19 are shown in this embodiment as optical sensors to identify when the vehicle has crossed a line near the intersection, but as noted the sensors may differ and/or vary depending on embodiment.

In various modified embodiments of the present invention, the sensors and computerized controller may work to increase intersection efficiency and flow-through based on tracked intersection data. For example, in one embodiment, when high traffic is detected in one direction, the system may allow more than one vehicle to enter the intersection at one time. This can be detected by the plurality of sensors and controlled by the controller in response to the detected high traffic. Alternatively or in addition, an external traffic data may be received and processed by the computerized controller. Further still, recorded data may be stored in memory, and the processor may automatically adjust based on the recorded data.

In another embodiment, the computerized controller may be configured to allow vehicles passing straight through the intersection to enter the intersection at the same time. This may be determined based on a sensor which can identify if a vehicle has a directional signal on, such as a camera or visual controller. Or this may be determined by allowing vehicles to enter the intersection by default in two opposite directions, only stopping this flow of traffic if a vehicle approaches from a different direction from the two opposite directions. In a similar embodiment, if vehicles on opposite sides of the intersection are turning different ways, and this is determined by a sensor detecting a vehicle that is using its directional signal (such as a camera detection), the computerized controller may receive this information and instruct both vehicles, via the display(s) to proceed.

In still another embodiment of optimized operation, a non-busy intersection may default to allow any vehicle to enter the intersection, unless another approaching car is nearing the intersection. When multiple vehicles are approaching, the computerized controller may determine to control the intersection by, for example, stopping one, multiple, or all cars. The sensors of the present invention may be used to detect these approaching vehicles.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. An intersection control system comprising:

a plurality of sensors, at least one of the plurality of sensors fixedly positioned at each of a plurality of sides of a road intersection;

a display fixedly positioned at at least one of the plurality of sides of the road intersection, the display being visible to at least one of the plurality of sides of the road intersection;

a computerized controller in communication with the plurality of sensors and the display, the computerized controller configured to cause the display to present a position in line that a vehicle is in to enter the road intersection, the computerized controller configured to count down an order as the vehicle's turn to enter the intersection approaches on the display, and configured to cause the display to provide an indication on the display when it is the vehicle's turn to enter the intersection.

2. The system of claim 1 wherein the at least one of the plurality of sensors identifies when a vehicle on its side of the road intersection enters the intersection, the computerized controller configured to receive an input from the at least one of the plurality of sensors to indicate that the vehicle has entered the intersection, and configured to cause the display to count down once this indication is received.

3. The system of claim 1 further comprising a plurality of displays, one of the displays at each of the plurality of sides of the road intersection, wherein each of the plurality of displays is in electronic communication with the computerized controller, and wherein the computerized controller configured to cause each of the plurality of displays to count down the order as the vehicle's turn approaches, and configured to cause each of the plurality of displays to provide an indication when it is time for the vehicle on the side of the intersection where the one of the plurality of displays to enter the intersection.

4. The system of claim 3, wherein one of the plurality of displays are configured to provide the indication that it is the vehicle's turn to enter the intersection unless one of the plurality of sensors detects that a vehicle enters a side of the intersection that is different from the side that the one of the plurality of displays is on.

5. The system of claim 3 wherein the computerized controller is configured to receive a traffic information and configured to cause the display to provide additional indications to enter the intersection on the one of plurality of displays based on the traffic information.

6. The system of claim 5 wherein the traffic information is recorded by at least one of the plurality of sensors.

7. The system of claim 3, wherein two of the plurality of displays are configured to provide the indication that it is the vehicle's turn to enter the intersection unless a vehicle approaches a side of the intersection that is different from the side that the two of the plurality of displays is on, the two of the plurality of displays being on opposite sides of the intersection.

8. The system of claim 1 wherein each of the plurality of sensors is a weight sensor.

9. The system of claim 1 wherein at least one of the plurality of sensors is physically separate from the display.

10. An intersection control system comprising:

a plurality of sensors, at least one of the plurality of sensors fixedly positioned at each of a plurality of sides of a road intersection;

a display fixedly positioned adjacent to the intersection the display being visible to at least one of the plurality of sides of the road intersection;

a computerized controller in communication with the plurality of sensors and the display, the computerized controller configured to:

assign an indicator to each of a plurality of sides of an intersection;

cause the display to present one of the indicators assigned to the plurality of sides of the intersection, the displayed indicator corresponding to a vehicle at one of the plurality of sides of the intersection whose turn it is to enter the road intersection.

11. The system of claim 10 wherein the at least one of the plurality of sensors identifies when a vehicle on its side of the road intersection enters the intersection, the computerized controller configured to receive a communication from the at least one of the plurality of sensors to indicate that the vehicle has entered the intersection, and configured to cause the display to change the indicator once this indication is received.

12. The system of claim 10 further comprising at least one camera in communication with the computerized controller.

13. The system of claim 10 further comprising a plurality of displays, one of the displays at each of the plurality of sides of the road intersection, wherein each of the plurality of displays is in electronic communication with the computerized controller, and wherein the computerized controller configured to cause each of the plurality of displays to present the one of the indicators assigned to the plurality of sides of the intersection, the displayed indicator corresponding to the vehicle at the one of the plurality of sides of the intersection whose turn it is to enter the road intersection.

14. The system of claim 13, wherein each of the plurality of displays is configured to provide the indication that it is the vehicle's turn to enter the intersection until one of the plurality of sensors identifies a vehicle at a side of the intersection that is different from the side that the one of the plurality of displays is on.

15. The system of claim 13 wherein the computerized controller is configured to receive a traffic information and configured to cause the plurality of displays to provide additional indications to enter the intersection on the one of plurality of displays.

16. The system of claim 15 wherein the traffic information is recorded by at least one of the plurality of sensors.

17. The system of claim 13, wherein the computerized controller is configured to cause the two of the plurality of displays to present two of the numbers assigned to the opposite of the plurality of sides of the intersection, the displayed numbers corresponding to a vehicle at one of the plurality of sides of the intersection whose turn it is to enter the road intersection unless a vehicle enters a side of the intersection that is different from the side that the two of the plurality of displays is on, the two of the plurality of displays being on opposite sides of the intersection.

18. The system of claim 10 wherein the indicator is a number.

19. The system of claim 10 wherein each of the plurality of sensors is a weight sensor.

20. The system of claim 10 wherein at least one of the plurality of sensors is physically separate from the display.

* * * * *